US011591785B2

(12) United States Patent
Maruyama et al.

(10) Patent No.: US 11,591,785 B2
(45) Date of Patent: Feb. 28, 2023

(54) FLUSH TOILET

(71) Applicant: TOTO LTD., Kitakyushu (JP)

(72) Inventors: Takahiro Maruyama, Kitakyushu (JP); Wataru Ishimi, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 0 days.

(21) Appl. No.: 17/680,439

(22) Filed: Feb. 25, 2022

(65) Prior Publication Data

US 2022/0275620 A1 Sep. 1, 2022

(30) Foreign Application Priority Data

Feb. 26, 2021 (JP) ..... 2021-030145

(51) Int. Cl.

| | |
|---|---|
| ***E03D 11/02*** | (2006.01) |
| ***E03D 11/18*** | (2006.01) |
| ***E03D 1/26*** | (2006.01) |
| ***E03D 5/01*** | (2006.01) |

(52) U.S. Cl.

CPC ..... *E03D 11/02* (2013.01); *E03D 1/26* (2013.01); *E03D 11/18* (2013.01); *E03D 5/01* (2013.01)

(58) Field of Classification Search

CPC E03D 1/26; E03D 11/18; E03D 11/02; E03D 5/01

See application file for complete search history.

(56) References Cited

U.S. PATENT DOCUMENTS

2017/0370086 A1* 12/2017 Momoe ..... E03D 5/01

FOREIGN PATENT DOCUMENTS

| | | |
|---|---|---|
| JP | 2014-114632 A | 6/2014 |
| JP | 2017-89282 A | 5/2017 |

* cited by examiner

*Primary Examiner* — Janie M Loeppke
(74) *Attorney, Agent, or Firm* — BakerHostetler

(57) ABSTRACT

A flush toilet includes a rear storage configured to store a control unit of a toilet main body. The rear storage includes a supporting wall configured to support the control unit so as to divide a storage region of the rear storage into upper and lower regions. In a rear supporting region of the rear storage, a first distance in a horizontal left-right direction from an outer joining portion to an inner joining portion in the supporting wall is shorter than a second distance in the horizontal left-right direction from an outer wall in the double wall of the skirt to an inner joining portion of the supporting wall. The second distance is set to a maximum width dimension in the left-right direction in an internal space of the double wall of the skirt.

4 Claims, 7 Drawing Sheets

FLUSH TOILET

CROSS REFERENCE TO RELATED APPLICATION

This application claims benefit of priority to Japanese Patent Application No. 2021-030145, filed on Feb. 26, 2021, the entire content of which is incorporated herein by reference.

FIELD OF THE INVENTION

The present invention relates to a flush toilet, and more particularly, to a flush toilet which is flushed with flush water to discharge waste.

BACKGROUND OF THE INVENTION

Conventionally, as a flush toilet which is flushed with flush water to discharge waste, there is known, for example, as described in Patent Document 1 (Japanese Patent Laid-Open No. 2017-89282) and Patent Document 2 (Japanese Patent Laid-Open No. 2014-114632), a so-called "full skirt" or "total Hakama" flush toilet in which a skirt formed on an outer side than a side surface of each of a bowl of a toilet main body made of ceramics and a water discharge trap is formed all around the toilet main body. In this conventional "full skirt" or "total Hakama" flush toilet, a storage region that can store a control unit including a function of controlling the spout water to the bowl of the toilet main body is provided in a region more rearward than the bowl of the toilet main body.

Further, in a conventional flush toilet described in Patent Document 1, a side wall of a skirt forms a double wall including an outer wall forming an outer surface, and an inner wall provided inside this outer wall. The side wall of the skirt has a structure of the double wall, forms an internal space between the outer wall and the inner wall in the double wall and is attached to a supporting wall that supports the control unit in a storage region of the control unit of the toilet main body. Furthermore, in a conventional flush toilet described in Patent Document 2, a supporting wall provided in a storage region of a control unit of a toilet main body extends in a horizontal direction from an attached portion to a water discharge trap to skirts on opposite left and right sides. Opposite left and right ends of this supporting wall are attached to single wall portions of side walls of the left and right skirts, respectively, and in the side wall of the skirt below the attached portion, a double wall is formed. That is, the opposite left and right ends of the supporting wall are supported by the single wall portion above the attached portion to the skirt, and are also supported by the double wall below the attached portion to the skirt.

On the other hand, one of aims that have been requested to be achieved in recent years with design diversification of the flush toilet and improvement in design such as appearance of the flush toilet is to acquire a large storage region that stores a control unit in a region more rearward than a bowl of a toilet main body, while reducing (slimming) an external dimension of the whole toilet main body. For example, in the conventional flush toilet described in Patent Document 1, the double wall of the side wall of the skirt is attached to the supporting wall of the storage region of the control unit, and hence a storage section with a sufficient strength to withstand a weight of the control unit can be acquired. However, there is a problem that a structure of the side wall of the skirt with a thickness of the double wall in an entire region from a lower end to an upper end reduces and narrows the storage region of the control unit. Furthermore, in the conventional flush toilet described in Patent Document 2, a region of the skirt below the attached portion between the supporting wall provided in the storage region of the control unit and each of the left and right side walls of the skirt is a double wall, and a region of the skirt above the attached portion between the supporting wall and each of the left and right side walls of the skirt is a single wall portion. Consequently, there is a problem that the storage region of the control unit cannot be acquired in a region below the horizontal supporting wall and is integrated in the region above the horizontal supporting wall, and hence it is difficult to acquire a large storage region of the control unit in each of the regions below and above the wall part. Also, the storage region integrated in the region above the supporting wall is surrounded with the single wall portion of the side wall of the skirt and might lack strength depending on a weight of the control unit stored in a storage part, and there is a problem that deformation such as distortion of the supporting wall or the skirt affects an appearance shape or the like of the toilet main body.

Accordingly, the present invention is aimed at solving problems of the conventional arts described above and is aimed at providing a flush toilet in which a large storage region of a control unit in a toilet main body can be acquired while suppressing an external dimension of the whole toilet main body, and in which strength can be increased while ensuring design and productivity for the whole toilet main body.

SUMMARY OF THE INVENTION

To solve the problems described above, an aspect of the present invention is a flush toilet comprising: a toilet main body made of ceramics, the toilet main body including a bowl configured to receive waste, and a water discharge trap configured to discharge waste in the bowl, the water discharge trap including an inlet connected to a lower portion of the bowl, and a control unit provided more rearward than the bowl of the toilet main body, the control unit being configured to control discharge and stopping of flush water to the bowl, wherein the toilet main body further includes a skirt and a rear storage configured to store at least a part of the control unit, the skirt being formed on an outer side than a side surface of each of the bowl and the water discharge trap, and a rear storage being provided below an upper end of the skirt and on an inner side than the skirt in a region more rearward than the bowl, the rear storage includes a supporting wall configured to support the control unit so as to divide a storage region of the rear storage into upper and lower regions, the skirt forms a double wall including an outer wall and an inner wall, the outer wall forms an outer surface, the inner wall is provided inside the outer wall, and the double wall has at least a part forming an internal space between the outer wall and the inner wall, the inner wall in the double wall of the skirt includes an upper inner wall and a lower inner wall, the upper inner wall extends upward from an outer joining portion located outside the supporting wall in a left-right direction, and the lower inner wall extends downward from an inner joining portion located inside the outer joining portion in the left-right direction in the supporting wall, the rear storage includes a rear supporting region with a first distance in a horizontal left-right direction from the outer joining portion to the inner joining portion in the supporting wall, the first distance being shorter than a second distance in the horizontal left-right direction from the outer wall in the double wall of the skirt to the inner joining portion of the supporting wall, and the second distance is set to a maximum width dimension in the left-right direction in the internal space of the double wall. According to the aspect of the present invention having such a configuration as described above, the first distance in the horizontal left-right direction from the outer joining portion to the inner joining portion in the supporting wall in the rear supporting region of the rear storage is shorter than the second distance in the horizontal left-right direction from the outer wall in the double wall of the skirt to the inner joining portion of the supporting wall, and the second distance is set to the maximum width dimension in the left-right direction in the internal space of the double wall of the skirt. Consequently, the upper inner wall and the lower inner wall in the double wall of the skirt, which are joined to the outer joining portion and the inner joining portion in the supporting wall, respectively, can securely hold the supporting wall from the up-down direction, so that the rear supporting region of the rear storage can have increased strength. Also, deformation such as distortion of the supporting wall in the rear supporting region of the rear storage can be suppressed, and hence strength reduction in the rear storage and the whole toilet main body and impact on external appearance can be suppressed. As a result, a large storage region of the control unit in the toilet main body can be acquired while suppressing an external dimension of the whole toilet main body, and strength can be increased while ensuring design and productivity for the whole toilet main body.

In the aspect of the present invention, preferably, the rear storage includes a front supporting region provided on a front side of the rear supporting region, and in the front supporting region, the supporting wall is joined to a joining portion to which the upper inner wall and the lower inner wall in the double wall of the skirt are joined. According to the aspect of the present invention having such a configuration as described above, the supporting wall in the front supporting region of the rear storage is joined to the joining portion to which the upper inner wall and the lower inner wall in the double wall of the skirt are joined, so that each of the upper inner wall and the lower inner wall in the double wall of the skirt can securely hold the supporting wall in the front supporting region of the rear storage from the up-down direction. Therefore, strength of the supporting wall itself in the front supporting region of the rear storage can be acquired, and strength of the joining portion of the supporting wall to the upper inner wall and the lower inner wall in the double wall of the skirt can be acquired. Consequently, deformation such as distortion of the supporting wall in the front supporting region of the rear storage can be suppressed, and the strength reduction in the rear storage and the whole toilet main body and the impact on the external appearance can be suppressed.

In the aspect of the present invention, preferably, the rear supporting region is provided more rearward than a joining portion between the water discharge trap and the supporting wall. According to the aspect of the present invention having such a configuration as described above, the supporting wall that supports the water discharge trap is easy to be affected by deformation such as distortion in a peripheral portion of the joining portion between the supporting wall and the water discharge trap, due to a weight of the water discharge trap. However, in the rear supporting region of the rear storage, strength of the joining portion of the supporting wall to the upper inner wall and the lower inner wall in the double wall of the skirt is increased, so that the joining portion can be inhibited from being affected by the deformation, such as the distortion, of the supporting wall in the peripheral portion of the joining portion between the supporting wall and the water discharge trap. Also, the supporting wall in the rear supporting region of the rear storage that is provided more rearward than the joining portion between the water discharge trap and the supporting wall can be inhibited from being distorted or deformed, because the supporting wall has a rear portion and left and right side portions joined to the skirt on rear, left and right sides of the water discharge trap. Therefore, strength of the supporting wall in the rear supporting region of the rear storage can increase, and hence strength reduction in the rear storage and the whole toilet main body and the impact on the external appearance can be effectively suppressed.

In the aspect of the present invention, preferably, the supporting wall includes an upper lateral wall that is joined to the water discharge trap, a vertical wall that is joined to outside of the upper lateral wall and extends downward, and a lower lateral wall that is provided below the upper lateral wall and joined to the vertical wall, and the lower inner wall in the double wall of the skirt is joined to the supporting wall to extend into a lower region from a joining portion between the vertical wall and the lower lateral wall in the supporting wall. According to the aspect of the present invention having such a configuration as described above, for the supporting wall of the rear storage, the vertical wall is provided between the upper lateral wall and the lower lateral wall, so that a storage region within the rear storage can be formed in a shape including a step between the upper lateral wall and the lower lateral wall, and a larger storage region within the rear storage can be acquired. Also, to acquire the larger storage region within the rear storage, even with the stepped shape, the lower inner wall in the double wall of the skirt is joined to the supporting wall to extend into the lower region from the joining portion between the vertical wall and the lower lateral wall in the supporting wall, so that the strength of the supporting wall of the rear storage can be acquired by the lower inner wall in the double wall of the skirt. Therefore, the strength reduction in the rear storage and the whole toilet main body and the impact on the external appearance can be suppressed.

In the aspect of the present invention, preferably, the lower inner wall in the double wall of the skirt is formed in such a manner that at least a part of a lower end of the lower inner wall extends to an installation surface on which the toilet main body is installed. According to the aspect of the present invention having such a configuration as described above, at least a part of the lower end of the lower inner wall in the double wall of the skirt is formed to extend to the installation surface on which the toilet main body is installed, so that the lower inner wall in the double wall of the skirt is stably supported by the installation surface. Consequently, the lower inner wall in the double wall of the skirt can further stably support the supporting wall, so that the strength of the supporting wall of the rear storage can be acquired. Therefore, the strength reduction in the rear storage and the whole toilet main body and the impact on the external appearance can be suppressed.

According to the flush toilet of the aspect of the present invention, a large storage region of the control unit in the toilet main body can be acquired while suppressing an external dimension of the whole toilet main body, and strength can be increased while ensuring design and productivity for the whole toilet main body.

DETAILED DESCRIPTION OF THE PREFERRED EMBODIMENT

Figure 1:
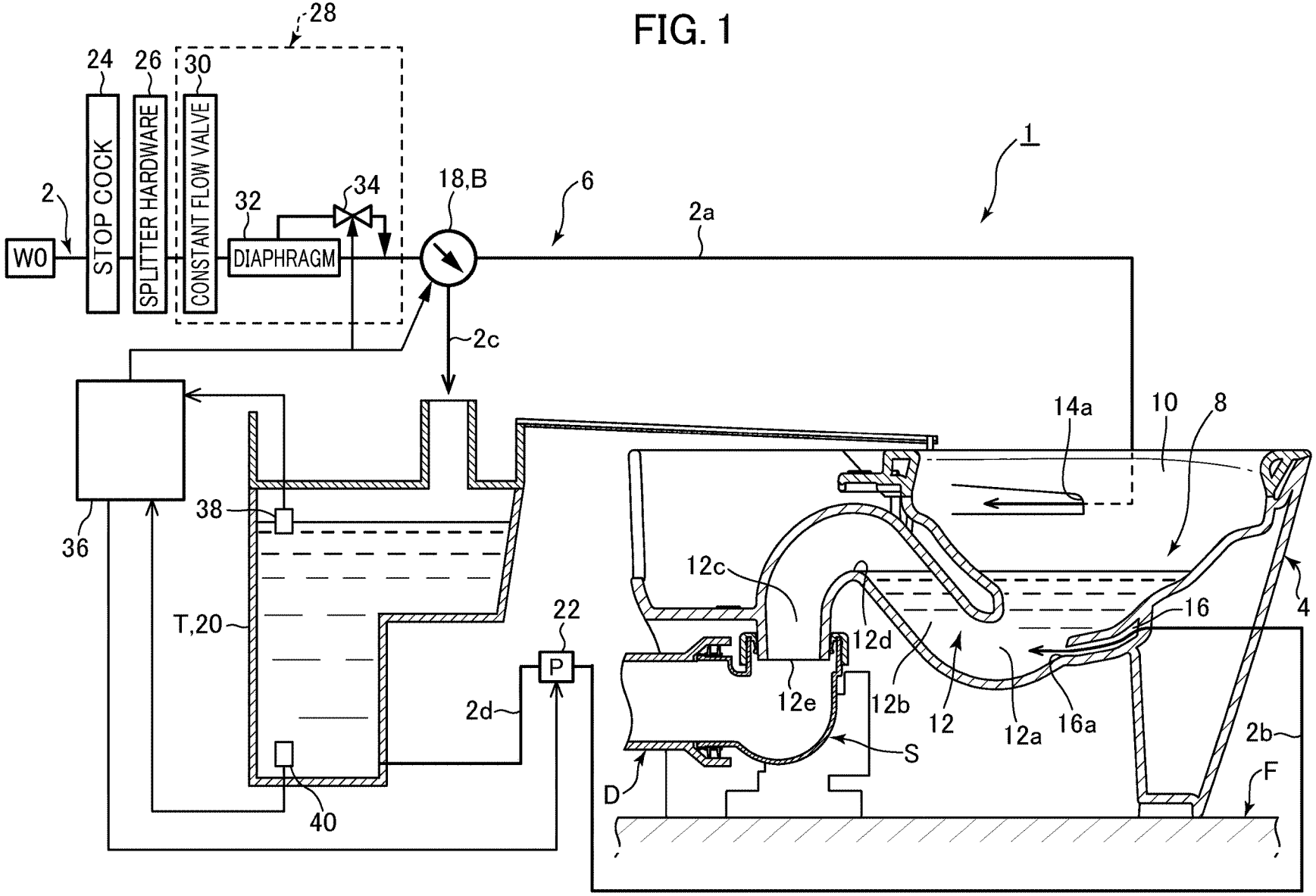
FIG. 1 is an overall structural diagram of a flush toilet according to an embodiment of the present invention.
Figure 2:
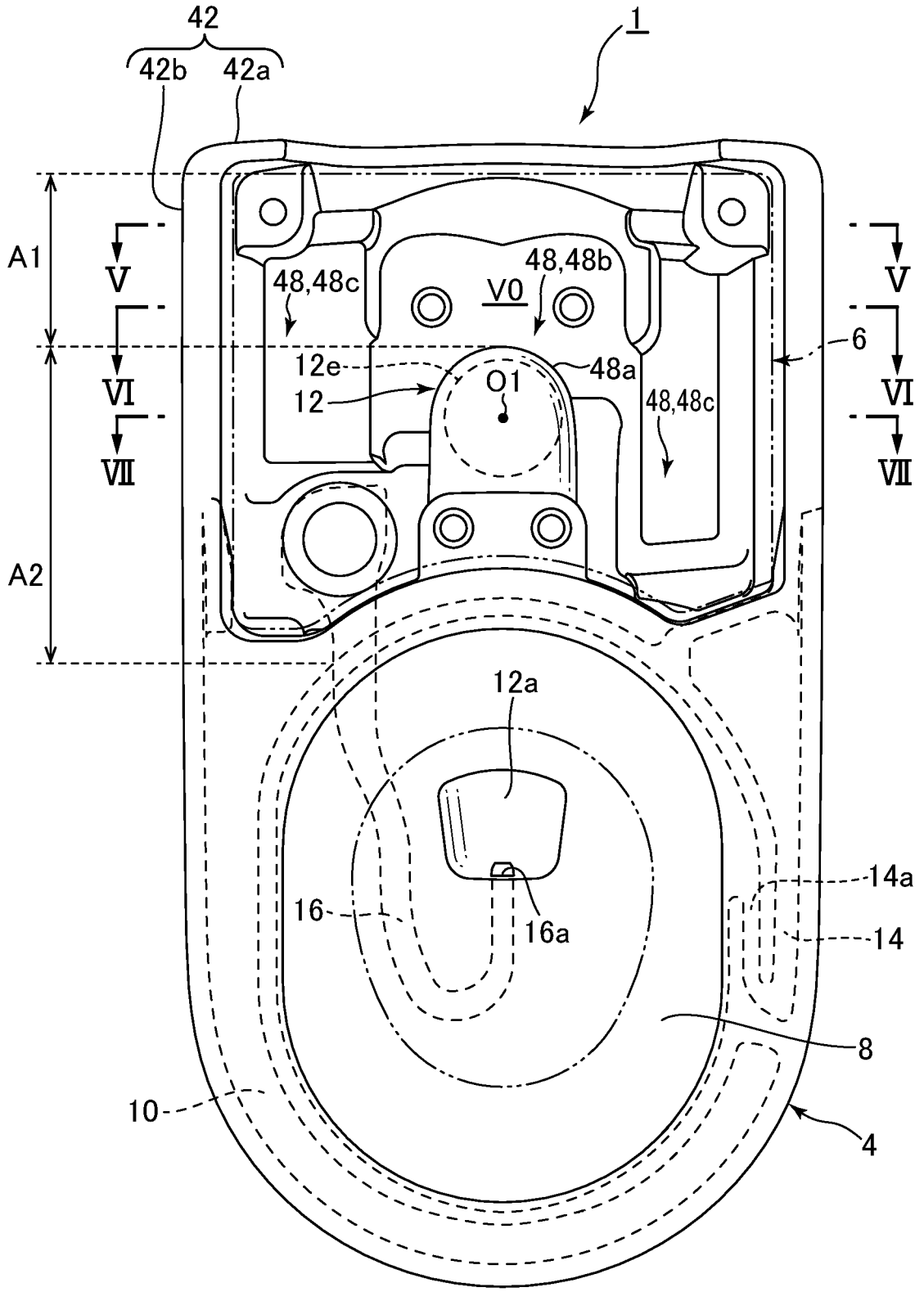
FIG. 2 is a plan view of the flush toilet according to the embodiment of the present invention.
Figure 3:
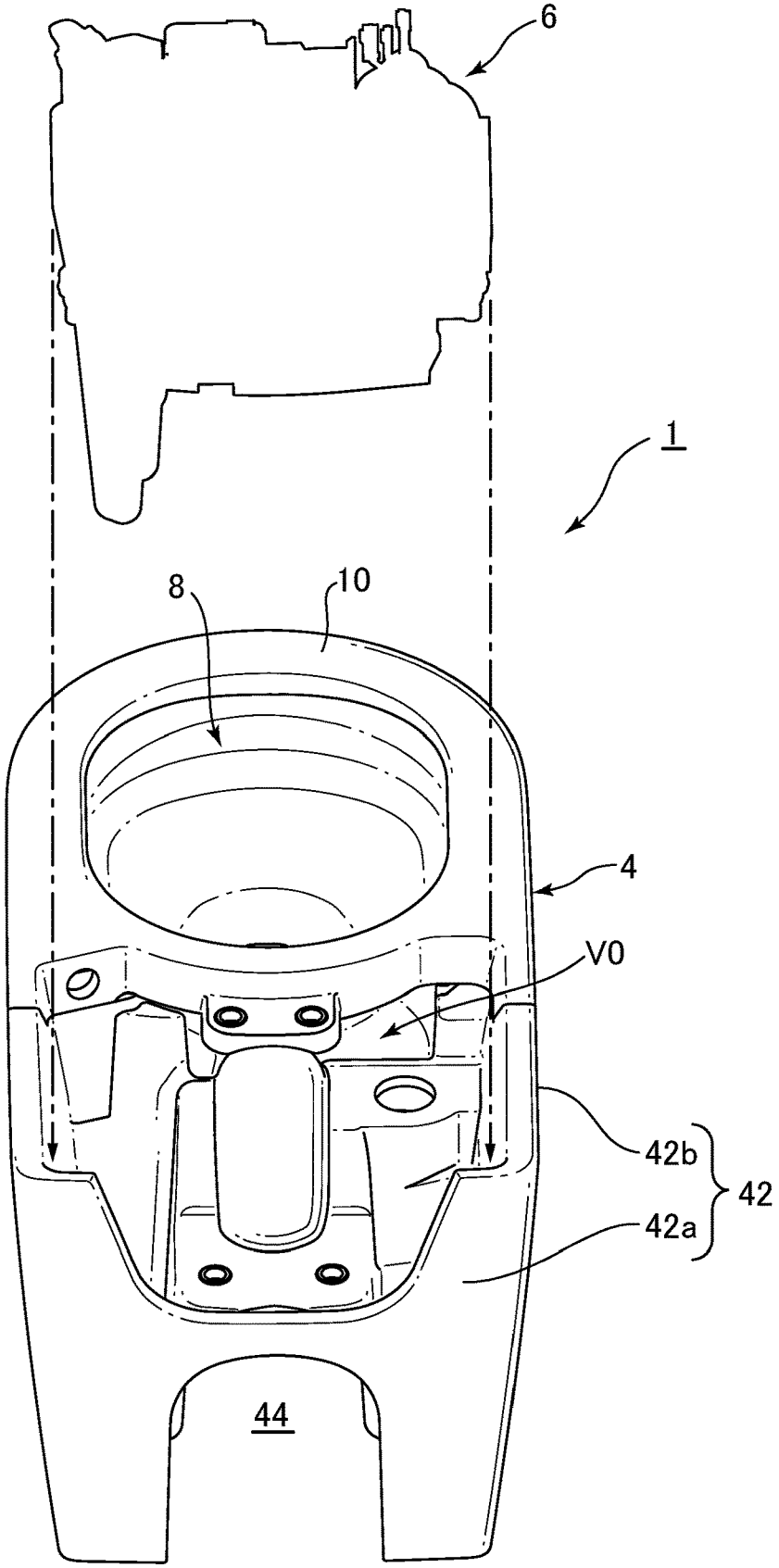
FIG. 3 is an exploded perspective view of the flush toilet according to the embodiment of the present invention seen from rear and diagonally above.
Figure 4:
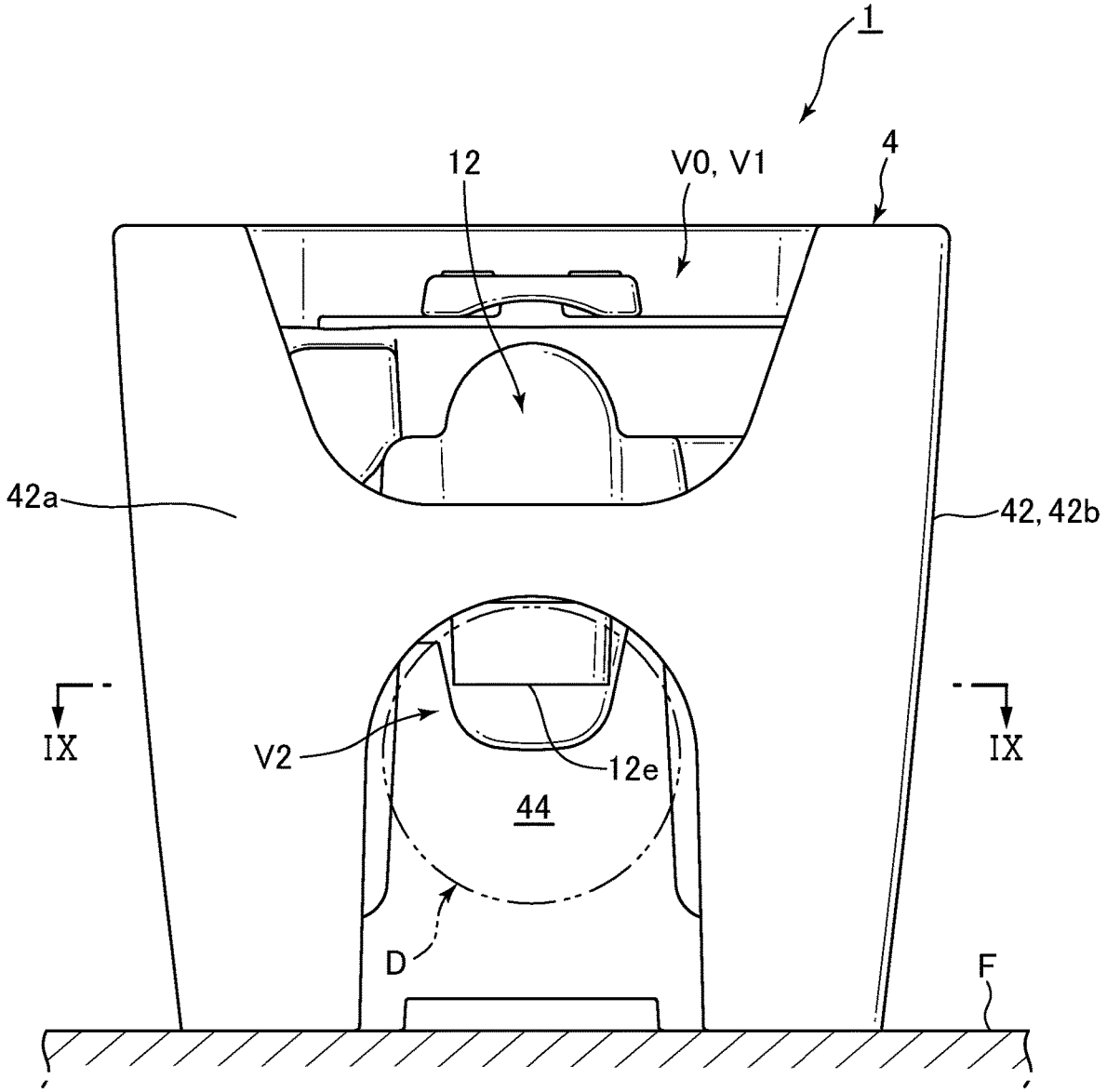
FIG. 4 is a back view of the flush toilet according to the embodiment of the present invention.

Hereinafter, a flush toilet according to an embodiment of the present invention will be described with reference to the accompanying drawings. First, an entire configuration of the flush toilet according to the embodiment of the present invention will be schematically described with reference to FIGS. 1 to 3. As shown in FIGS. 1 to 3, a flush toilet 1 according to the embodiment of the present invention includes a water supply channel (a main water passageway 2) where flush water that is supplied from a main water supply source WO such as a water system flows through, a toilet main body 4 made of ceramics, and a flush water supply device 6.

Next, as shown in FIGS. 1 to 3, the toilet main body 4 includes a bowl 8 for receiving waste, a rim 10 that is formed at a top edge of the bowl 8, and a water discharge trap 12 extending from a bottom portion of the bowl 8. Furthermore, as shown in FIGS. 1 to 3, although details will be given later, the flush water supply device 6 is a control unit that is provided more rearward than the bowl 8 of the toilet main body 4 and that enables flush water supplied from the main water passageway 2 to be supplied to the toilet main body 4. More specifically, this control unit includes a function of controlling discharge and stopping of flush water to the bowl 8 of the toilet main body 4 by operating on power.

Next, as shown in FIG. 2, a rim conduit 14 is formed in the rim 10 on one of left and right sides of the toilet main body 4 (right side of the toilet main body 4 seen from front). The rim conduit 14 has a so-called U-turn shape that extends forward from the rear side of the toilet main body 4 and then bends rearward, in the rim 10 on one of the left and right sides of the toilet main body 4 (right side of the toilet main body 4 seen from front). Further, a rim spout port 14*a* is provided on a downstream end (downstream rear end) of the rim conduit 14. Furthermore, a rim-side water supply channel 2*a* of the flush water supply device 6, of which more later, is connected on an upstream side of the rim conduit 14 of the toilet main body 4. Flush water that is supplied from the rim-side water supply channel 2*a* to the rim spout port 14*a* is discharged into the bowl 8, rearward from the rim spout port 14*a*, and rim spouting is thus performed.

Next, as shown in FIGS. 1 and 2, a jet conduit 16 is formed extending from an outer surface of the bowl 8 of the toilet main body 4 to the bottom portion. A downstream side of the jet conduit 16 faces an inlet 12*a* of the water discharge trap 12 at the bottom portion of the bowl 8, and a jet spout port 16*a* is provided on a downstream end of the jet conduit 16. Furthermore, a jet-side water supply channel 2*b* of the flush water supply device 6, of which more later, is provided on an upstream side of the jet conduit 16 of the toilet main body 4. Flush water that is supplied from the jet-side water supply channel 2*b* to the jet conduit 16 of the toilet main body 4 is discharged from the jet spout port 16*a* toward the water discharge trap 12, and jet spouting is thus performed. Now, as shown in FIG. 1, an upstream side of the rim-side water supply channel 2*a* of the flush water supply device 6 is connected to a switching valve 18 (of which more later) at a branch part B on the main water passageway 2. For its part, an upstream side of the jet-side water supply channel 2*b* of the flush water supply device 6 is connected to a pressure pump 22 (of which more later) of the flush water supply device 6 provided on a downstream side of a storage tank 20 of the flush water supply device 6, as shown in FIG. 1.

Next, the water discharge trap 12 of the toilet main body 4 includes the inlet 12*a* provided at the bottom portion of the bowl 8, an ascending pipe 12*b* that ascends from the inlet 12*a*, and a descending pipe 12*c* that descends from the ascending pipe 12*b*, and a part between the ascending pipe 12*b* and the descending pipe 12*c* is a top portion 12*d*. Also, as shown in FIG. 1, an outlet 12*e* of the descending pipe 12*c* of the water discharge trap 12 is connected to an inlet of a discharge socket S that is disposed behind and below the toilet main body 4. Furthermore, as shown in FIG. 1, an outlet of the discharge socket S on the rear side is connected to an inlet of a drain pipe D extending from a wall (not shown) on the rear side of the toilet main body 4. Consequently, a so-called water discharge mode of "wall side water discharge" is formed where water discharged through the outlet 12*e* of the water discharge trap 12 of the toilet main body 4 is discharged from the discharge socket S to the drain pipe D on a wall side. Additionally, the flush toilet 1 of the present embodiment is not limited to this water discharge mode of "wall side water discharge", and is applicable to a so-called water discharge mode of "floor side water discharge" where water discharged through the outlet 12*e* of the water discharge trap 12 of the toilet main body 4 is discharged from the discharge socket S to a drain pipe provided below an installation surface (floor F) of a bottom surface of the toilet main body 4.

Next, each configuration of the flush water supply device 6 of the flush toilet 1 according to the present embodiment will be schematically described with reference to FIG. 1. First, as shown in FIG. 1, the flush water supply device 6 includes, from an upstream side to a downstream side of the main water passageway 2, a stop cock 24, splitter hardware 26, a valve unit 28, and the switching valve 18. Next, the valve unit 28 includes a constant flow valve 30, a diaphragm main valve 32, and an electromagnetic valve 34 such as a solenoid valve. Furthermore, the flush water supply device 6 includes a controller 36. The controller 36 is capable of functioning as a controller that controls an opening-closing operation of an on-off valve (the electromagnetic valve 34) of the valve unit 28, a switching operation of the switching valve 18, and a rotational speed, an operation time, and the like of the pressure pump 22.

Moreover, the constant flow valve 30 of the valve unit 28 is for reducing flush water passing from the stop cock 24 on the main water passageway 2 and through the splitter hardware 26 to or below a predetermined flow rate. Additionally, in a mode where the flush toilet 1 is provided with a private part washing device (not shown), a water supply pipe (not shown) for supplying flush water to the private part washing device (not shown) may also be connected to the splitter hardware 26. Furthermore, at the valve unit 28, when an opening operation is performed on the electromagnetic valve 34 by the controller 36, the main valve 32 is opened, and flush water passing from the constant flow valve 30 and through the main valve 32 is supplied to the switching valve 18 at the branch part B on the downstream side of the main water passageway 2. The switching valve 18 is capable of supplying flush water from the main water passageway 2 to the rim-side water supply channel 2*a* and a tank-side water supply channel 2*c* at a same timing, and a ratio between water supplied to the rim side and water supplied to the tank side may be freely changed.

Next, the flush water supply device 6 includes a tank device T that enables flush water supplied from the main water passageway 2 to be supplied to the toilet main body 4. The tank device T includes the storage tank 20 that is coupled to a rear side of the toilet main body 4 and that is for storing flush water supplied from the main water passageway 2, and the pump (the pressure pump 22) for feeding the flush water in the storage tank 20 to the toilet main body 4 under pressure. Furthermore, the rim-side water supply channel 2*a* that communicates with the rim conduit 14 of the toilet main body 4, and the tank-side water supply channel 2*c* that is connected to the storage tank 20 are provided on the downstream side of the branch part B on the downstream side of the main water passageway 2. Accordingly, flush water that is supplied from the main water supply source WO to the branch part B of the main water passageway 2 is used as water to be supplied to at least one of the rim-side water supply channel 2*a* to be supplied to the rim and the tank-side water supply channel 2*c* to be supplied to the tank.

Furthermore, the flush water supply device 6 includes a pump water supply channel 2*d* that extends from a downstream side of the tank-side water supply channel 2*c* to the pressure pump 22, and the jet-side water supply channel 2*b* that extends on a downstream side from the pressure pump 22. Accordingly, with the flush toilet 1 of the present embodiment, flush water that is supplied from the main water passageway 2 and that is directly under tap water pressure may be supplied from the rim-side water supply channel 2*a* of the flush water supply device 6 to the rim spout port 14*a*, via the rim conduit 14 of the toilet main body 4, and water may thus be spouted from the rim spout port 14*a* (so-called "rim spouting"). Furthermore, the flush water supplied from the main water passageway 2 to the flush water supply device 6 may flow through the tank-side water supply channel 2*c*, the storage tank 20, the pump water supply channel 2*d* and the pressure pump 22 of the flush water supply device 6 and then be supplied from the jet-side water supply channel 2*b* to the jet spout port 16*a*, via the jet conduit 16 of the toilet main body 4, and water may thus be spouted from the jet spout port 16*a* (so-called "jet spouting"). That is, the flush toilet 1 of the present embodiment may function as a so-called hybrid flush toilet 1 that is capable of using, in combination, rim spouting that uses flush water that is supplied from the main water passageway 2 and that is directly under tap water pressure, and jet spouting that uses flush water that is from the storage tank 20 and that is pressurized by the pressure pump 22.

Now, an upper float switch 38 and a lower float switch 40 are disposed inside the storage tank 20. A water level inside the storage tank 20 may be detected by these float switches 38, 40. For example, the upper float switch 38 is switched on when the water level inside the storage tank 20 reaches a predetermined water storage level, and the controller 36 detects an on state of the upper float switch 38 and causes the electromagnetic valve 34 to close. For its part, the lower float switch 40 is switched on when the water level inside the storage tank 20 falls to a predetermined water level below the predetermined water storage level that is detected by the upper float switch 38, and the controller 36 detects an on state of the lower float switch 40 and causes the pressure pump 22 to stop. Furthermore, the pressure pump 22 is for causing flush water stored in the storage tank 20 to be discharged from the jet spout port 16*a*, by suctioning the flush water into the pump water supply channel 2*d* and pressurizing the flush water in the pump water supply channel 2*d* into the jet-side water supply channel 2*b*.

With the structures described above, at a time of normal toilet flushing, the controller 36 detects an operation of a toilet flushing switch (not shown) by a user, for example, and causes the electromagnetic valve 34, the switching valve 18, and the pressure pump 22 to sequentially operate. Discharging of water from the rim spout port 14*a* and the jet spout port 16*a* is thus sequentially started, and flush water used to flush the bowl 8 is discharged from the water discharge trap 12, together with waste in the bowl 8. Furthermore, when flushing is over, the controller 36 opens the electromagnetic valve 34, and the switching valve 18 is switched to the tank-side water supply channel 2*c* side, and flush water in the main water passageway 2 is used to refill the storage tank 20. Then, when the water level inside the storage tank 20 rises and the upper float switch 38 detects a specified water storage amount, the controller 36 closes the electromagnetic valve 34, so that the main valve 32 closes the main water passageway 2, and supply of water is thereby stopped. Moreover, each unit of the flush water supply device 6 (control unit) is stored in a rear storage V0 (of which more later) in a region more rearward than the bowl 8 of the toilet main body 4.

Next, specific description will be given to the rear storage V0 where the flush water supply device 6 (control unit) is stored in the toilet main body 4 of the flush toilet 1 according to the present embodiment, and a peripheral structure of the rear storage V0 with reference to FIGS. 2 to 7. Here, the flush toilet 1 of the present embodiment shown in FIGS. 4 to 7 does not show the flush water supply device 6.

First, as shown in FIGS. 2 to 7, the toilet main body 4 includes a skirt 42 formed on an outer side than a side surface of each of the bowl 8 and the water discharge trap 12. Also, the rear storage V0 of the toilet main body 4 is provided below an upper end of the skirt 42 and on an inner side than the skirt 42 in the region more rearward than the bowl 8 of the toilet main body 4, to form a storage region that can store at least a part of the flush water supply device 6 (control unit).

Figure 5:
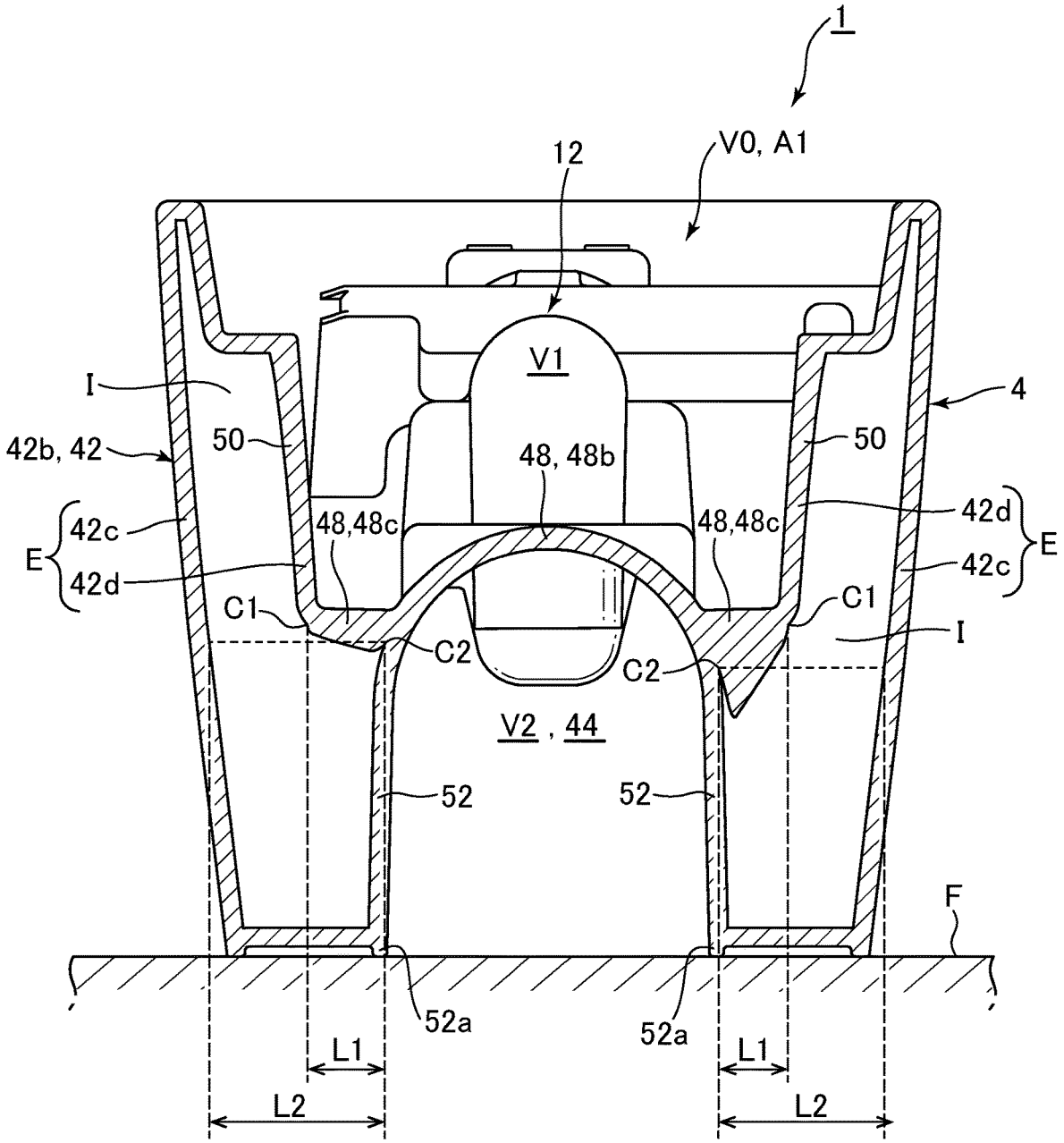
FIG. 5 is a cross-sectional view taken along a line V-V of FIG. 2.
Figure 6:
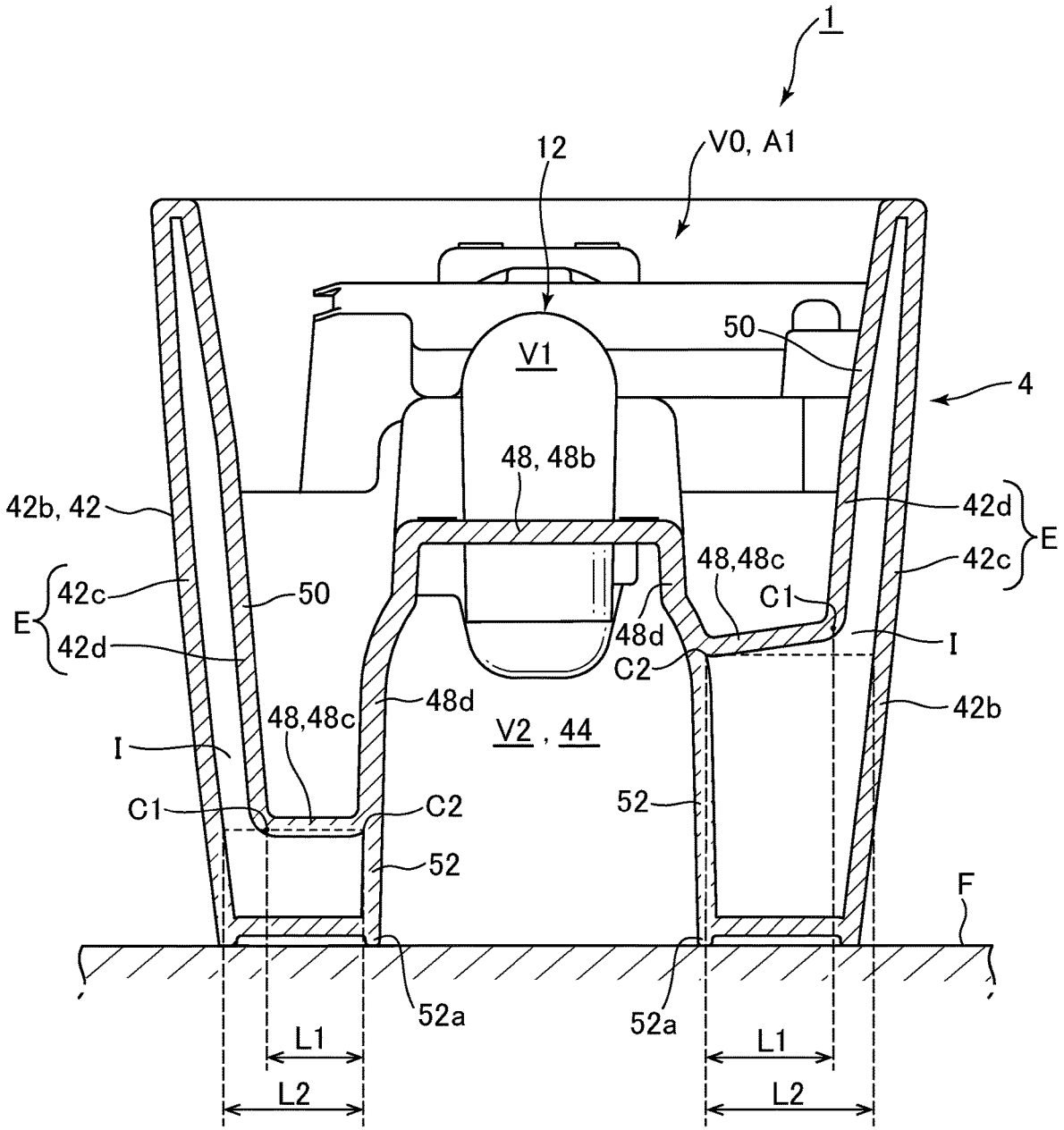
FIG. 6 is a cross-sectional view taken along a line VI-VI of FIG. 2.
Figure 7:
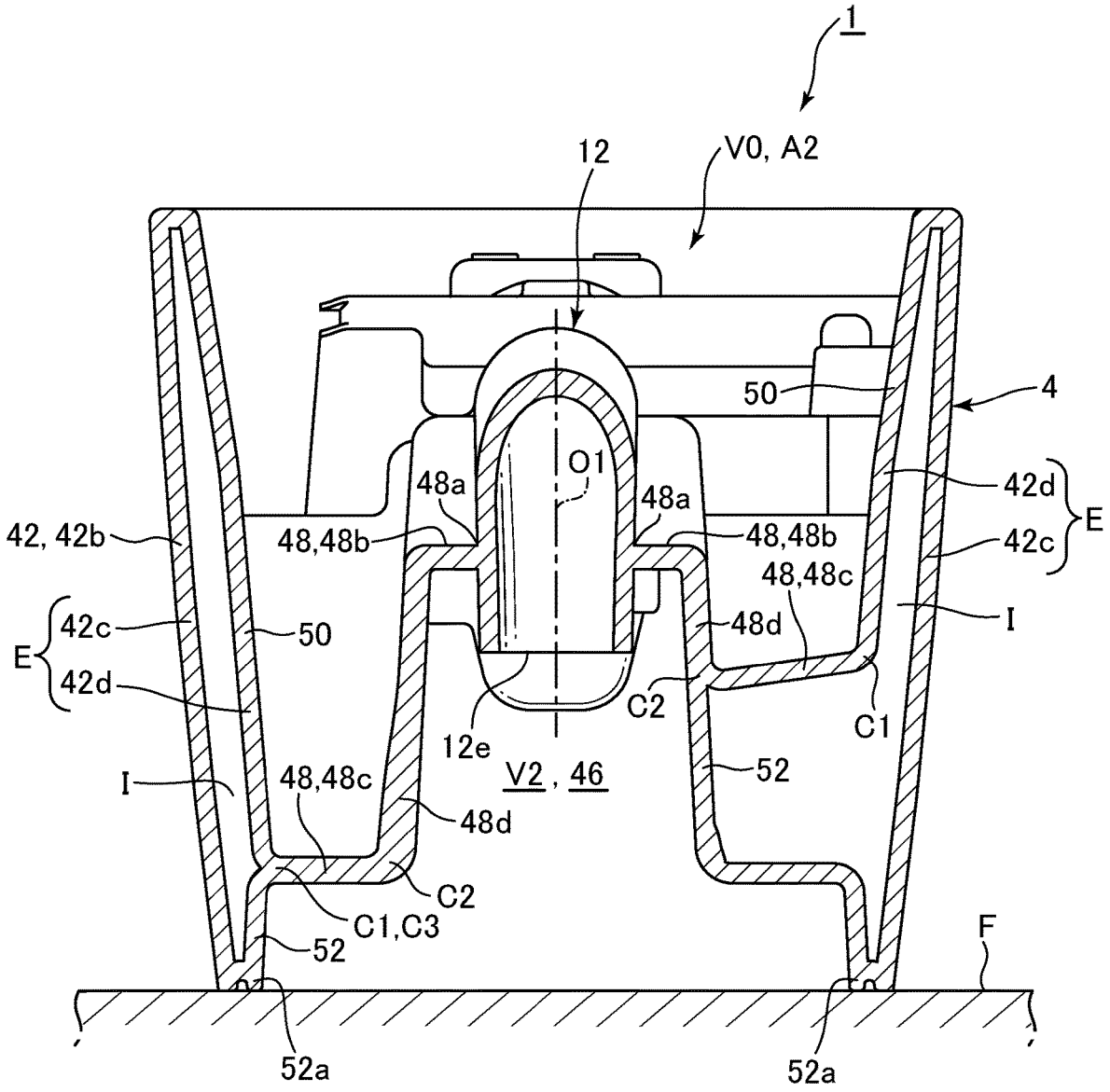
FIG. 7 is a cross-sectional view taken along a line VII-VII of FIG. 2.

Next, as shown in FIGS. 2 to 7, the skirt 42 includes a rear wall 42*a* provided on a back surface of the toilet main body 4, and a side wall 42*b* provided on each of left and right side surfaces of the toilet main body 4 seen from front. Here, as shown in FIGS. 5 to 7, each of the rear wall 42*a* and the side wall 42*b* of the skirt 42 includes an outer wall 42*c* that forms an outer surface of the skirt 42, and an inner wall 42*d* provided inside the outer wall 42*c*. The outer wall 42*c* and the inner wall 42*d* form a double wall E. Also, the double wall E forms an internal space I between the outer wall 42*c* and the inner wall 42*d*.

Also, an opening 44 to which the drain pipe D is connected is formed to penetrate, in a front-rear direction, a lower portion of a center in a left-right direction seen from front in the rear wall 42*a* of the skirt 42. Furthermore, as shown in FIGS. 4 to 7, a discharge socket storage section 46 is formed on a front side of the opening 44 in a lower region of a center of the rear storage V0 in the left-right direction in the toilet main body 4. The discharge socket storage section 46 functions as a storage region that can store the discharge socket S (see FIG. 1) connected to the outlet 12*e* of the descending pipe 12*c* of the water discharge trap 12.

Next, as shown in FIGS. 5 to 7, the rear storage V0 includes a supporting wall 48 that supports the flush water supply device 6 (control unit). The supporting wall 48 is attached to the water discharge trap 12 and divides, in an up-down direction, a storage region of the rear storage V0 into an upper region V1 and a lower region V2. Also, the upper region V1 of the rear storage V0 includes a storage region that stores at least a part of the flush water supply device 6 (control unit), and the lower region V2 of the rear storage V0 includes an open region of each of the opening 44 and the discharge socket storage section 46.

Next, as shown in FIGS. 2 and 5 to 7, the supporting wall 48 of the rear storage V0 includes an upper lateral wall 48*b* that extends in a horizontal direction from a joining portion 48*a* between the supporting wall and the water discharge trap 12 to opposite left and right sides and a rear side. Also, the supporting wall 48 includes a lower lateral wall 48*c* provided outside the upper lateral wall 48*b* in a left-right direction and below the upper lateral wall. The lower lateral wall 48*c* on an outer side in the left-right direction is joined to the inner wall 42*d* of the double wall E in each of the left and right side walls 42*b* of the skirt 42. Furthermore, the supporting wall 48 includes a vertical wall 48*d* that extends downward from each of left and right outer end portions of the upper lateral wall 48*b* to each of left and right inner end portions of the lower lateral wall. Also, a lower inner wall 52 in the double wall E of the side wall 42*b* of the skirt 42 is joined to the supporting wall 48 to extend into a lower region from a joining portion C2 between the vertical wall 48*d* and the lower lateral wall 48*c* in the supporting wall 48.

Next, as shown in FIG. 5, the inner wall 42*d* in the double wall E of the side wall 42*b* of the skirt 42 includes an upper inner wall 50 that extends upward from an outer joining portion C1 located outside the supporting wall 48 in the left-right direction. Also, the inner wall 42*d* in the double wall E of the side wall 42*b* of the skirt 42 includes the lower inner wall 52 that extends downward from an inner joining portion C2 located inside the outer joining portion C1 in the supporting wall 48 in the left-right direction.

Further, as shown in FIGS. 6 and 7, the lower inner wall 52 in the double wall E of the side wall 42*b* of the skirt 42 is joined to the supporting wall 48 to extend into the lower region from the joining portion C2 between the vertical wall 48*d* and the lower lateral wall 48*c* in the supporting wall 48. Also, as shown in FIGS. 5 to 7, the lower inner wall 52 in the double wall E of the side wall 42*b* of the skirt 42 includes a lower end 52*a* formed to extend to an installation surface (a floor surface F) on which the toilet main body 4 is installed.

Further, as shown in FIG. 2, in the rear storage V0, a rear supporting region A1 where the control unit (flush water supply device 6) is supported by the supporting wall 48 is provided more rearward than the joining portion 48*a* between the water discharge trap 12 and the supporting wall 48. Also, as shown in FIGS. 5 and 6, in the rear supporting region A1, a first distance L1 in a horizontal left-right direction from the outer joining portion C1 to the inner joining portion C2 in the supporting wall 48 is set to be shorter than a second distance L2 in the horizontal left-right direction from the outer wall 42*c* in the double wall E in the side wall 42*b* of the skirt 42 to the inner joining portion C2 of the supporting wall 48 (L1<L2). Additionally, the second distance L2 is set to a maximum width dimension in the left-right direction in the internal space I of the double wall E in the side wall 42*b* of the skirt 42.

Next, as shown in FIG. 2, the rear storage V0 includes a front supporting region A2 provided on a front side of the rear supporting region A1. Also, as shown in FIG. 7, in the front supporting region A2 of the rear storage V0, the lower lateral wall 48*c* of the supporting wall 48 is joined to a joining portion C3 to which the upper inner wall 50 and the lower inner wall 52 in the double wall E of the side wall 42*b* of the skirt 42 are joined. Here, a region joined to the joining portion C3 is formed in at least a part of the front supporting region A2 and may be formed only on one of left and right sides of the toilet main body 4 as shown in FIG. 7.

Next, description will be given to operation of the flush toilet 1 according to the above embodiment of the present invention with reference to FIGS. 1 to 7. First, according to the flush toilet 1 of the embodiment of the present invention, the first distance L1 in the horizontal left-right direction from the outer joining portion C1 to the inner joining portion C2 in the supporting wall 48 in the rear supporting region A1 of the rear storage V0 is shorter than the second distance L2 in the horizontal left-right direction from the outer wall 42*c* in the double wall E of the side wall 42*b* of the skirt 42 to the inner joining portion C2 of the supporting wall 48 (L1<L2), and the second distance L2 is set to the maximum width dimension in the left-right direction in the internal space I of the double wall E of the side wall 42*b* of the skirt 42. Consequently, the upper inner wall 50 and the lower inner wall 52 in the double wall E of the side wall 42*b* of the skirt 42, which are joined to the outer joining portion C1 and the inner joining portion C2 in the supporting wall 48, respectively, can securely hold the supporting wall 48 from the up-down direction, so that the rear supporting region A1 of the rear storage V0 can have increased strength. Also, deformation such as distortion of the supporting wall 48 in the rear supporting region A1 of the rear storage V0 can be suppressed, and hence strength reduction in the rear storage V0 and the whole toilet main body 4 and impact on external appearance can be suppressed. As a result, a large storage region of the control unit (flush water supply device 6) in the toilet main body 4 can be acquired while suppressing an external dimension of the whole toilet main body 4, and strength can be increased while ensuring design and productivity for the whole toilet main body 4.

Also, according to the flush toilet 1 of the present embodiment, the supporting wall 48 in the front supporting region A2 of the rear storage V0 is joined to the joining portion C3 to which the upper inner wall 50 and the lower inner wall 52 in the double wall of the side wall 42*b* of the skirt 42 are joined. Thus, each of the upper inner wall 50 and the lower inner wall 52 in the double wall of the side wall 42*b* of the skirt 42 can securely hold the supporting wall 48 in the front supporting region A2 of the rear storage V0 from the up-down direction. Therefore, strength of the supporting wall 48 itself in the front supporting region A2 of the rear storage V0 can be acquired, and strength of the joining portion C3 of the supporting wall 48 to the upper inner wall 50 and the lower inner wall 52 in the double wall E of the side wall 42*b* of the skirt 42 can be acquired. Consequently, deformation such as distortion of the supporting wall 48 in the front supporting region A2 of the rear storage V0 can be suppressed, and the strength reduction in the rear storage V0 and the whole toilet main body 4 and the impact on the external appearance can be suppressed.

Furthermore, according to the flush toilet 1 of the present embodiment, the supporting wall 48 that supports the water discharge trap 12 is easy to be affected by deformation such as distortion in a peripheral portion of the joining portion 48*a* between the supporting wall and the water discharge trap 12, due to a weight of the water discharge trap 12. However, in the rear supporting region A1 of the rear storage V0, strength of the joining portion of the supporting wall 48 to the upper inner wall 50 and the lower inner wall 52 in the double wall E of the side wall 42*b* of the skirt 42 is increased, so that the joining portion can be inhibited from being affected by the deformation, such as the distortion, of the supporting wall 48 in the peripheral portion of the joining portion 48*a* between the supporting wall and the water discharge trap 12. Also, the supporting wall 48 in the rear supporting region A1 of the rear storage V0 that is provided more rearward than the joining portion 48*a* between the water discharge trap 12 and the supporting wall 48 can be inhibited from being distorted or deformed, because the supporting wall has a rear portion and left and right side portions joined to the skirt 42 (the rear wall 42*a* and the side wall 42*b*) provided on rear, left and right sides of the water discharge trap 12. Therefore, strength of the supporting wall 48 in the rear supporting region A1 of the rear storage V0 can increase, and hence strength reduction in the rear storage V0 and the whole toilet main body 4 and the impact on the external appearance can be effectively suppressed.

Also, according to the flush toilet 1 of the present embodiment, for the supporting wall 48 of the rear storage V0, the vertical wall 48*d* is provided between the upper lateral wall 48*b* and the lower lateral wall 48*c*, so that a storage region within the rear storage V0 can be formed in a shape including a step between the upper lateral wall 48*b* and the lower lateral wall 48*c*, and a larger storage region within the rear storage V0 can be acquired. Further, to acquire the larger storage region within the rear storage V0, even with the stepped shape, the lower inner wall 52 in the double wall E of the side wall 42*b* of the skirt 42 is joined to the supporting wall 48 to extend into the lower region from the joining portion C2 between the vertical wall 48*d* and the lower lateral wall 48*c* in the supporting wall 48. Consequently, the strength of the supporting wall 48 of the rear storage V0 can be acquired by the lower inner wall 52 in the double wall E of the side wall 42*b* of the skirt 42. Therefore, the strength reduction in the rear storage V0 and the whole toilet main body 4 and the impact on the external appearance can be suppressed.

Furthermore, according to the flush toilet 1 of the present embodiment, the lower end 52*a* of the lower inner wall 52 in the double wall E of the side wall 42*b* of the skirt 42 is formed to extend to the installation surface (floor surface F) on which the toilet main body 4 is installed, so that the lower inner wall 52 in the double wall E of the side wall 42*b* of the skirt 42 is stably supported by the installation surface (floor surface F). Consequently, the lower inner wall 52 in the double wall E of the side wall 42*b* of the skirt 42 can further stably support the supporting wall 48, so that the strength of the supporting wall 48 of the rear storage V0 can be acquired. Therefore, the strength reduction in the rear storage V0 and the whole toilet main body 4 and the impact on the external appearance can be suppressed.

Alternatively, as a modification of the flush toilet 1 according to the embodiment of the present invention, the supporting wall 48 in the rear supporting region A1 of the rear storage V0 may be joined to the joining portion C3 to which the upper inner wall 50 and the lower inner wall 52 in the double wall E of the side wall 42*b* of the skirt 42 are joined, and the supporting wall 48 in the front supporting region A2 may be joined to the joining portions C1 and C2 to which the upper inner wall 50 and the lower inner wall 52 in the double wall E of the side wall 42*b* of the skirt 42 are joined.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A flush toilet comprising:

a toilet main body made of ceramics, the toilet main body including a bowl configured to receive waste, and a water discharge trap configured to discharge waste in the bowl, the water discharge trap including an inlet connected to a lower portion of the bowl, and a control unit provided more rearward than the bowl of the toilet main body, the control unit being configured to control discharge and stopping of flush water to the bowl, wherein the toilet main body further includes a skirt and a rear storage configured to store at least a part of the control unit, the skirt being formed on an outer side than a side surface of each of the bowl and the water discharge trap, and a rear storage being provided below an upper end of the skirt and on an inner side than the skirt in a region more rearward than the bowl, the rear storage includes a supporting wall configured to support the control unit so as to divide a storage region of the rear storage into upper and lower regions, the skirt forms a double wall including an outer wall and an inner wall, the outer wall forms an outer surface, the inner wall is provided inside the outer wall, and the double wall has at least a part forming an internal space between the outer wall and the inner wall, the inner wall in the double wall of the skirt includes an upper inner wall and a lower inner wall, the upper inner wall extends upward from an outer joining portion located outside the supporting wall in a left-right direction, and the lower inner wall extends downward from an inner joining portion located inside the outer joining portion in the left-right direction in the supporting wall, the rear storage includes a rear supporting region with a first distance in a horizontal left-right direction from the outer joining portion to the inner joining portion in the supporting wall, the first distance being shorter than a second distance in the horizontal left-right direction from the outer wall in the double wall of the skirt to the inner joining portion of the supporting wall, the second distance is set to a maximum width dimension in the left-right direction in the internal space of the double wall, and wherein the rear storage includes a front supporting region provided on a front side of the rear supporting region, and in the front supporting region, the supporting wall is joined to a joining portion to which the upper inner wall and the lower inner wall in the double wall of the skirt are joined.

2. The flush toilet according to claim 1, wherein the rear supporting region is provided more rearward than a joining portion between the water discharge trap and the supporting wall.

3. The flush toilet according to claim 1, wherein the supporting wall includes an upper lateral wall, a vertical wall and a lower lateral wall, the upper lateral wall being joined to the water discharge trap, the vertical wall being joined to outside of the upper lateral wall and extends downward, and the lower lateral wall being provided below the upper lateral wall and joined to the vertical wall, and the lower inner wall in the double wall of the skirt is joined to the supporting wall to extend into a lower region from a joining portion between the vertical wall and the lower lateral wall in the supporting wall.

4. The flush toilet according to claim 1, wherein the lower inner wall in the double wall of the skirt is formed in such a manner that at least a part of a lower end of the lower inner wall extends to an installation surface on which the toilet main body is installed.

* * * * *